United States Patent [19]

Bard et al.

[11] Patent Number: 4,870,795

[45] Date of Patent: Oct. 3, 1989

[54] CERAMIC WALL OR FLOOR COVERING CONSISTING OF SINGLE TILE-SHAPED ELEMENTS

[75] Inventors: Martin Bard, Amberg; Hans G. Baumgart, Schwarzenfeld, both of Fed. Rep. of Germany

[73] Assignee: Buchtal GmbH, Fed. Rep. of Germany

[21] Appl. No.: 210,099

[22] Filed: Jun. 22, 1988

[30] Foreign Application Priority Data

Jun. 22, 1987 [DE] Fed. Rep. of Germany ..... 3720598

[51] Int. Cl.[4] ..... E04F 13/08

[52] U.S. Cl. ..... 52/389; 52/173 R

[58] Field of Search ..... 52/389, 388, 387, 386, 52/385, 173; 174/48

[56] References Cited

U.S. PATENT DOCUMENTS

| | | | |
|---|---|---|---|
| Re. 28,756 | 4/1976 | Fork | 52/221 X |
| 3,025,934 | 3/1962 | Spiselman et al. | 52/126.6 |
| 4,677,801 | 7/1987 | Bard | 52/389 |

FOREIGN PATENT DOCUMENTS

| | | |
|---|---|---|
| 0211284 | 2/1987 | European Pat. Off. . |
| 1771361 | 3/1970 | Fed. Rep. of Germany . |

OTHER PUBLICATIONS

Produkie & Anwendungen: Baukeramik, 8/84, p. 96.

*Primary Examiner*—David A. Scherbel
*Assistant Examiner*—Creighton Smith
*Attorney, Agent, or Firm*—Reese Taylor

[57] ABSTRACT

In a ceramic wall or floor covering consisting of single tile-shaped elements which are designed to be electrically conductive, the electrical voltage is dissipated via the flanks of the tile-shaped ceramic element and via electrically conductive elements laid on the tile plane.

10 Claims, 2 Drawing Sheets

CERAMIC WALL OR FLOOR COVERING CONSISTING OF SINGLE TILE-SHAPED ELEMENTS

RELATED PATENT APPLICATIONS

This application claims priority under 35 U.S.C. 119 based on Federal Republic of Germany Application P3720598.6 filed June 22, 1987.

BACKGROUND OF THE INVENTION

The present invention relates to a covering and an electrically conductive means according to the introductory parts of claims 1 and 5.

Tile-shaped electrically conductive ceramic articles can be combined to form a covering for wall and floor linings and then communicate in electrically conductive fashion with an electrically dissipative conductive substructure. Such wall and/or floor constructions are particularly well-suited for operating rooms, laboratories, industrial rooms in danger of fire, such as paint shops, paint factories, warehouses for inflammable chemicals such as solvents or the like, etc. Nowadays there is also a need for such ceramic tiles in areas where a perceptible electrical discharge on persons is to be avoided, such as in office rooms containing computers and similar electrical and electronic equipment or where electronic components such as chips are produced. Floor coverings in operating rooms are expected to ensure constant dissipation of static electricity but at the same time prevent current from flowing off in a dangerous strength in case of contact between the human body and poorly insulated current-carrying parts. Such tile-shaped electrically conductive ceramic elements are also used here as elements of floor coverings. If they are to meet the requirements, such coverings must have an electrical resistance in the range of $10^4$ to $10^5$ ohms.

Such coverings made from ceramic tile-shaped elements have advantages compared to PVC and other synthetic coverings since the latter are insufficiently resistant to organic solvents and other chemicals used for cleaning and disinfection. Furthermore, electrically conductive organic adhesives whose conductivity values are not stable for long time periods must be used to connect such floor coverings to the electrically dissipative substructure.

Furthermore, carpet coverings made of synthetic fibers are known to charge themselves with static electricity, which one has attempted to avoid by weaving in or otherwise incorporating electrically conductive threads or wire meshes, a procedure which is expensive and does not even lead to satisfactory results.

The first attempt was to provide the visible side of tile-shaped ceramic elements for making such dissipative coverings with an electrically conductive coating. "Baukeramik" 8/84 p. 96 describes a grayish blue conductive tile in a 15×15 format which is made of ceramic material and has an electrically conductive coating drawn over the side edges, so that electricity can only be conducted away via the joint material abutting the edges of such tiles and this material must be made of basic substances made electrically conductive. Since such joint material is prone to aftercontraction, there is a danger of the electrical contact with the tile edges being lost at least in part. Furthermore, such joint material is quickly washed out when frequently cleaned, which may also lead to reduction of the contact surfaces. Not only does this alter the leakage resistance, the mechanical stability of the tiling also suffers. Furthermore, the contraction and the wear of the joint material create tiny spaces between the tile edges and the joint material which can be clogged with germs, which is absolutely intolerable in operating rooms, for example. Finally, the known tiles have a relatively small format, so that they do not have the local transition resistance required by the test standard (VDE rule 0100/5.73 Art. 24).

An improvement is described by European patent application No. 86 109 754.1 which is from the applicant. It discloses a tile-shaped ceramic element provided on the visible side with an electrically conductive surface glaze which, when the tile-like ceramic element is laid with a plurality of such elements to form a covering for wall or floor linings, communicates in conductive fashion with an electrically dissipative substructure to be provided under the covering. Such tiles can be laid to form a floor covering, for example, quite independently of the joint material, so that a joint material can be selected which completely meets all requirements for such a material in terms of its scuff resistance, its elasticity, in particular permanent elasticity, and its hygienic properties, and allows for at least part of the side of the tile-shaped ceramic element facing away from the visible side to be coated with a material that conducts electricity well and communicates in electrically conductive fashion with the surface glaze.

In order to allow for dissipation independently of the joint material, use has also been made of floor tiles made by firing molded mixtures of stoneware clay or potter's clay and iron oxide in an atmosphere customary for firing floor tiles. DE-B-17 71 361 describes a method for making such electrically semi-conductive ceramic floor tiles. However, since iron oxide is mixed into the ceramic material the unglazed ceramic surfaces have a dark color.

According to DE-B-12 78 321, electrically semi-conductive ceramic floor tiles are produced using mixtures which, due to the addition of further oxides such as ZnO, CuO, CoO, PbO, $Sb_2O_3$, BaO, CaO, MgO, etc., singly or mixed and in amounts of 0.5 to 7% relative to the fired body, are to effect a further reduction of specific resistance and allow for changes in the firing color ranging from red to black. These tiles are pressed out of the starting material and are therefore limited in their dimensions to 5×5 cm, for example, as indicated by a remark in DE-B 12 13 336.

This DE-B-12 13 336 also conveys to an expert a method for making electrically semi-conductive tiles by mixing a granular ceramic floor tile compound of the conventional type in a weight ratio of 4:1 to 12:1 with a ceramic compound containing $Fe_2O_3$ and other metallic oxides, preferably ZnO, which results in the fired state in an electrically conductive body, pressing this mixture into tiles and firing them at 1200° to 1250° C. in a normal industrial kiln in an oxidizing atmosphere.

All ceramic floor or wall coverings that are electrically conductive due to electrical body conduction or to electrically conductive surface glazes require, according to the current prior art, an electrically conductive substructure to ensure electrical dissipation. These substructures consist, for example, in grounded copper bands laid on the floor pavement and communicating with the electrically dissipating ceramic parts either directly or via electrically conductive adhesives. This type of dissipation via a substructure requires a very exact and elaborate laying of the dissipating parts and is relatively expensive and troublesome due to the costs resulting from this use and application of an electrically conductive adhesive. The aging stability of such adhesives also leaves something to be desired since it not only affects the mechanical strength but also the reliability of the electrically dissipating properties. The adhesive power of such electrically conductive adhesives is also limited due to the necessary admixture of electrically conductive particles which reduce the adhesive properties.

SUMMARY OF THE INVENTION

This is where the invention sets in. It proposes abandoning electrical dissipation with the aid of an electrically conductive substructure and ensuring it via the flanks of single electrically conductive ceramic elements and into the joint grid of embedded conductor paths, which are grounded themselves and have been made to communicate in electrically conductive fashion with the flanks of the ceramic elements. Since the conductor paths are located on the plane of the tile covering, the tile elements can be laid conventionally in a mortar bed on the existing floor pavement, thereby avoiding the mechanical adhesive deficiencies due to the use of organic adhesives and the resulting unreliable electrical dissipation. The precondition for the aimed at solution is that the electrical voltage applied to the tile surface is made available at the flanks of the ceramic tile elements due to expertly designed body conduction or extension of the electrically conductive surface glaze over these flanks. When the joints arising from the laying of tile-shaped ceramic bodies to form a covering are utilized as a given laying direction and place for taking up electrically conductive means, the latter can be made to communicate in electrically conductive fashion with the flanks of the adjacent tile elements. One can include all tile elements by selecting all available joints, preferably of one main direction, or at least every second joint of a main direction.

The electrically conductive means in the form of conductor paths can be designed in different forms, provided permanent contact is ensured between the conductor path and the flank of the tile element.

A preferred embodiment consists of a conductor path formed of an elastic core, e.g. rubber, and a sheath of highly conductive material, e.g. a stranded fabric of copper bronze or galvanized steel. A further design is a conductor path consisting of a wire provided with clasp-like bridge elements that clamp themselves against the flanks of the tile elements at predetermined intervals.

The conductor paths are brought together in the edge area of such a floor covering, possibly with the aid of crimp contacts, and grounded in a suitable manner.

The inventive solution allows not only for the conventional laying of the tile-shaped elements but also for the possibility of providing the joints with a joint material which completely meets all requirements in terms of scuff resistance, permanent elasticity and hygienic properties to be met by such a material, without the joint itself having to be made electrically conductive.

Unlike the known designs, the proposed solution makes it possible to determine the leakage resistance by selecting the number and length of the contact points per tile-shaped element. This is shown in particular for tiles with the same electrical dissipation ability, i.e. the same resistance value, which can be increased by the aforesaid measures, i.e. can take effect optionally with a value between $10^6$ and $10^8$ ohms.

The inventive solution also avoids the obvious disadvantage of having to accept an instability or noticeable change in the leakage resistance resulting from the unavoidable aging of the electrically conductive organic adhesive which must necessarily be used for electrical dissipation into the substructure. It also avoids the danger of weak points occurring when a tile-shaped ceramic element is not laid with a tight fit, and the resulting instability of the electrical working properties.

Since electrically conductive adhesives or mortars have lower specific electrical conductivity than pure metal as used according to the invention, and leak losses, due to the given possibility of concentrated linear dissipation, occur to a much lesser degree than in the case of a real dissipation via the substructure to conductor paths, there is also a lesser use of material, which leads to a cost savings and increases the reliability of dissipation.

The invention is particularly suitable for ensuring electrical dissipation in large-size tile-shaped ceramic elements, e.g. 60×60 cm, resulting in distances for the ground line in the order of at least twice the edge length of a tile.

In the case of smaller formats, it is expedient to combine a plurality of tiles into suitable composite elements electrically using small bridging elements which allow for dissipation from tile to tile and may be designed in accordance with the bridge elements of claim 9.

OF THE DRAWINGS

FIG. 1 shows a top view of a covering consisting of single tileshaped elements, FIG. 2 shows a cross-sectional view of the covering of FIG. 1, FIG. 3 shows a detail of the covering and a joint in an enlarged view, FIG. 4 shows a view corresponding to FIG. 3 of a further embodiment, FIG. 5 shows a perspective view of an embodiment of the electrically conductive means, and FIG. 6 shows a further embodiment of such a means.

DESCRIPTION OF THE PREFERRED EMBODIMENTS

Figure 1:
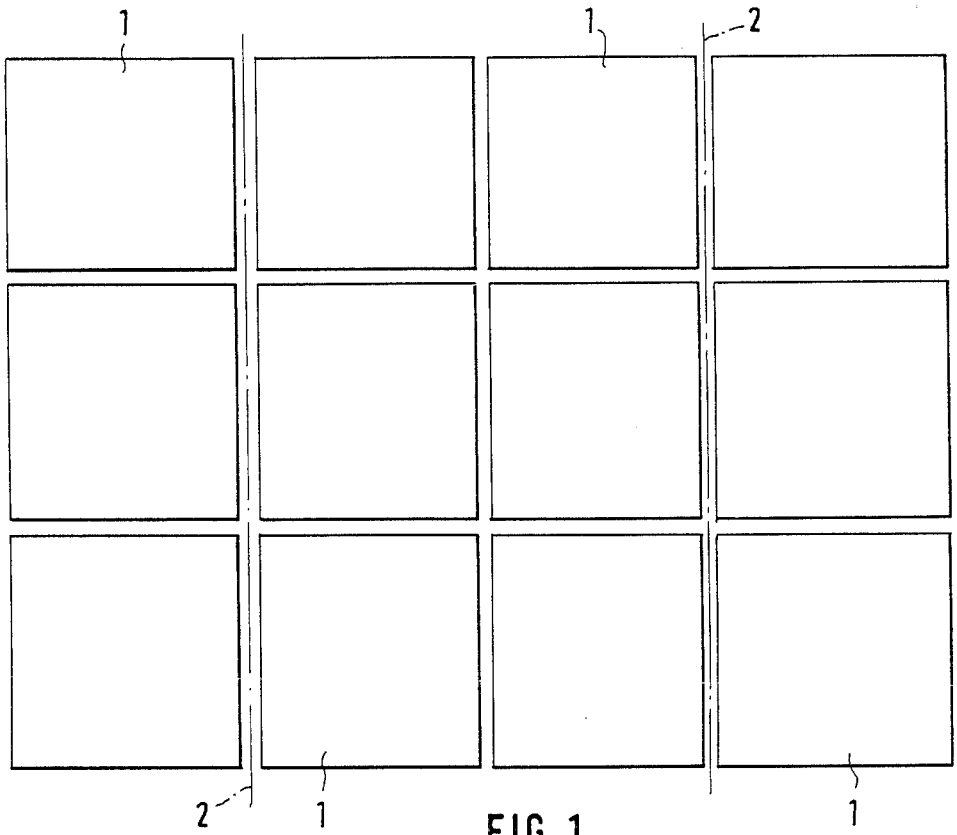

FIG. 1 shows a top view of a tile-shaped covering consisting of single electrically conductive elements 1, whereby electrically conductive means run in conformity with the joints, as shown by the tracks of these means.

Figure 2:
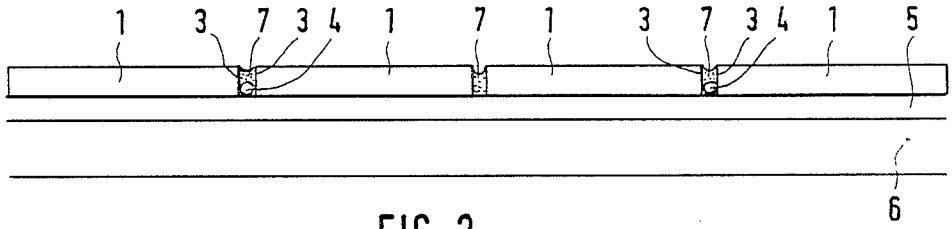

FIG. 2 shows this covering in cross-section. Here one can see the inventive design of electrically conductive elements 1, which communicate in electrically conductive fashion via their flanks 3 with an electrically conductive means 4. It is apparent that electrically conductive means 4 is laid on the tile plane. Elements 1 are permanently laid on a base 6 with the aid of a conventional, electrically nonconductive laying mortar. The joints are provided with an electrically nonconductive joint material 7. In the example shown, two pairs of tiles 1 are each associated with one electrically dissipating means, shown by track 2.

Figure 3:
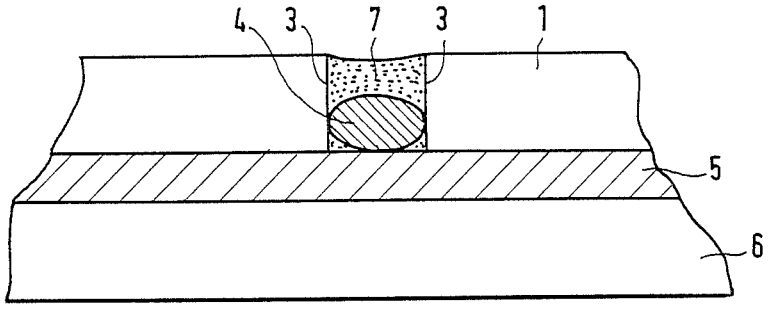

FIG. 3 shows an enlarged cross-sectional view of a possible design of an electrically conductive means 4 that communicates with electrically conductive flanks 3 of electrically conductive element 1, the laying on electrically nonconductive mortar 5 and a supporting base 6, and corresponding jointing 7.

Figure 4:
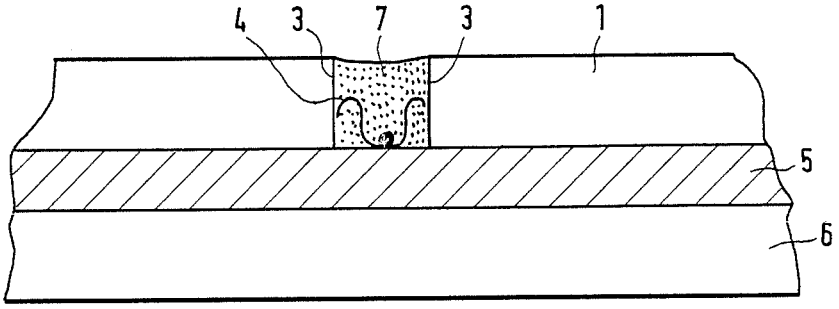

FIG. 4 shows an analogous view to that of FIG. 3, with the difference that electrically conductive means 4 consists here of a contact element clamping itself between flanks 3 of tile element 1.

Figure 5:
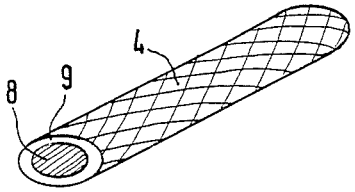

FIG. 5 shows a possible embodiment of strip-shaped electrically conductive means 4 which comprises a core 8 and a stranded sheath 9.

Figure 6:
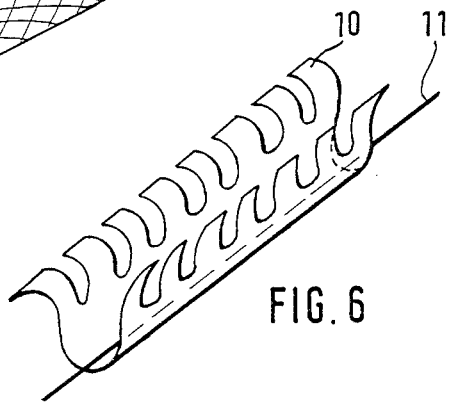

FIG. 6 shows a further embodiment of conductor-shaped electrically conductive means 4 which comprises a self-clamping contact element 10 and a corresponding conductor wire 11.

If the element is provided with an electrically conductive surface glaze, one expediently connects it with the electrically dissipating means by drawing the glaze over the flanks and thus contacting the means. In the case of body conduction, i.e. if conductive particles are embedded in the ceramic compound itself, the electrical connection is effected directly via the free flank surface of the element.

While a full and complete description of the invention has been set forth in accordance with the patent statutes, it should be understood that modifications can be resorted to without departing from the spirit hereof or the scope of the appended claims.

What is claimed is:

1. An electrically conductive, ceramic covering for floors or walls comprising:

a plurality of electrically conductive, ceramic tile elements;

each of said tile elements having two sides, at least one flat side and at least one edge or flank;

each said tile element placed in juxtaposition with another said tile element on a non-conductive substructure, forming a joint, such that each said flat side defines a portion of approximately the same plane;

electrically conductive means interposed between said tile elements in said joint and approximately in said plane;

said electrically conductive means electrically communicating with said edges or flanks.

2. A floor or wall covering as in claim 1, wherein a plurality of said joints are collinear.

3. A floor or wall covering as in claim 2, wherein each said ceramic tile has an electrically conductive surface glaze drawn at least one said side and over at least one said edge or flank.

4. A floor or wall covering as in claim 3, wherein said electrically conductive means are disposed on said plane.

5. A floor or wall covering as in claim 4, wherein said electrically conductive means is laid in the same direction as said collinear joints.

6. A floor or wall covering as in claim 1, wherein said electrically conductive means is a cable having an elastic core.

7. A floor or wall covering as in claim 6, wherein said elastic core is surrounded by a metallic, electrically conductive sheath.

8. A floor or wall covering as in claim 1, wherein said electrically conductive means is a metallic wire.

9. A floor or wall covering as in claim 1, wherein said electrically conductive means includes a plurality of electrically conductive contact elements which are self clamping to said edges or flanks.

10. A floor or wall covering as in claim 9, wherein the number of said contact elements per said ceramic tile and the length of said contact element are varied, such that the electrical resistance between said contact elements and said ceramic tiles is set between $10^5$ and $10^8$ ohms.

* * * * *